United States Patent [19]

Costigan

[11] Patent Number: 4,475,729

[45] Date of Patent: Oct. 9, 1984

[54] DRIVE PLATFORM FOR FABRIC SPREADING MACHINES

[75] Inventor: Conrad A. Costigan, Richmond Hill, N.Y.

[73] Assignee: Spreading Machine Exchange, Inc., New York, N.Y.

[21] Appl. No.: 567,396

[22] Filed: Dec. 30, 1983

[51] Int. Cl.[3] ..... B65H 29/46

[52] U.S. Cl. ..... 270/31; 38/143; 104/140; 104/305

[58] Field of Search ..... 270/30–31; 38/143; 112/121.14, 121.29, 217.3; 104/140, 305

[56] References Cited

U.S. PATENT DOCUMENTS

| | | | |
|---|---|---|---|
| 3,638,574 | 2/1972 | Paterson | 270/31 X |
| 3,791,641 | 2/1974 | Benson et al. | 270/31 |
| 3,951,398 | 4/1976 | Stumpf | 270/31 |
| 4,262,893 | 4/1981 | Sgrol | 270/31 |
| 4,339,118 | 7/1982 | Burton et al. | 270/31 |
| 4,355,794 | 10/1982 | Costigan | 270/31 |

*Primary Examiner*—E. H. Eickholt
*Attorney, Agent, or Firm*—Edward F. Levy

[57] ABSTRACT

A drive platform assembly is provided for attachment to the carriage of an existing manually-operable fabric spreading machine to convert the machine to motorized operation. The drive platform is connected to the fabric spreading carriage of the fabric spreading machine and includes a drive motor which drives the drive platform in both a forward and reverse direction thereby enabling the carriage to spread successive layers of fabric onto a cutting table. This motion of the drive platform is guided by guide wheel assemblies which cooperate with a guide track mounted on the cutting table. This apparatus includes a speed control and a pair of cam assemblies which automatically reverse the direction of travel of the drive platform and the fabric spreading carriage at the end of each spreading stroke. The drive platform assembly includes a platform upon which an operator may stand to regulate the speed of the fabric spreading carriage, and also to observe and regulate the spreading operation.

12 Claims, 9 Drawing Figures

DRIVE PLATFORM FOR FABRIC SPREADING MACHINES

BACKGROUND OF THE INVENTION

The prior art related to fabric spreading machines includes both manually operated machines and motor driven machines. In the manually operated fabric spreading machines a carriage, which holds a supply roll of fabric, is moved by hand along a cutting table thereby spreading fabric from the supply roll onto the table. The problems related to this machine, in addition to the difficulty in manually moving the carriage along the table, include the requirement for moving the carriage at a steady rate in order to prevent stretching or wrinkling of the fabric. In addition to manually moving the carriage along the table, the operator must constantly watch the fabric being deposited in order to correct stretching or wrinkling.

The above problems have been largely overcome through the provision of motor driven fabric spreading machines in which the carriage is driven along the surface of the cutting table by an electric motor. These problems however remain for fabric cutting enterprises which have invested in manual fabric spreading equipment and for whom economic factors, governing these enterprises, do not permit the scrapping of current equipment and the investment in newer motor driven equipment.

In some motor driven spreading machines an operator platform is mounted on one side of the machine carriage so as to move along the floor as the carriage is motor driven back and fourth along the cutting table. An operator stands on this platform and thus travels with the machine to observe the fabric operation, straightening the laid-down fabric by hand if it becomes wrinkled or is deposited out of alignment.

It is an object of the present invention to provide a drive platform assembly which is itself motor driven and which is adapted to be mounted on the carriage of existing manually operated fabric spreading machine in such a manner as to provide motorized operation of these machines and convert them into motor driven spreading machines.

Another object of the present invention is to provide a moving platform upon which an operator may stand to inspect the fabric while it is being deposited by the fabric spreading machine onto the cutting table.

Another object of the present invention is to provide a moving platform apparatus which enables an operator standing thereon to control the speed of a fabric spreading machine.

Another object of the present invention is to provide a drive platform apparatus capable of driving the carriage of a fabric spreading machine and reversing the direction of travel of the carriage to deposit successive layers of fabric onto a cutting table.

Still another object of the invention is to provide a drive platform for a fabric spreading machine which comprises a relatively small number of simple component parts which are economical of manufacture resulting in an overall low cost.

SUMMARY OF THE INVENTION

In accordance with the present invention there is provided a drive platform for manually operated fabric spreading machines which comprises a platform on which there is mounted a drive motor and an operator's control console. This platform is supported by a pair of axles on which drive wheels are mounted. The drive motor and the drive wheels are connected by sprocket chains which enable the drive motor to drive the drive wheels.

The motion of the platform is guided by a pair of guide wheel assemblies which are mounted on the platform and which have guide wheels which roll on a guide track mounted on the legs of the cutting table of the fabric spreading machine. The platform is connected to the fabric spreading carriage of the fabric spreading machine and the platform moves the carriage along the surface of the cutting table when the platform is driven by the drive motor.

The apparatus according to the present invention also includes a pair of cam assemblies which are mounted, one each, near the ends of the cutting table and limit switches mounted on the fabric spreading carriage. When the limit switches contact the cam assemblies, the motion of the platform and consequently the motion of the carriage is slowed, stopped and then reversed thereby spreading successive additional layers of fabric onto the cutting table.

The speed of travel of the platform may be controlled by an operator who stands on the platform in order to monitor the operation of the equipment. The speed of travel of the platform is controlled by using a speed control bar rotatably mounted on the operator's control console which is mounted on the platform. In addition to the speed control, the operator's console includes a power switch and indicators which indicate the direction of travel of the platform.

Additional objects and advantages the invention will become apparent during the course of the following specification, when taken in connection with the accompanying drawings, in which:

DESCRIPTION OF THE PREFERRED EMBODIMENTS

Figure 1:
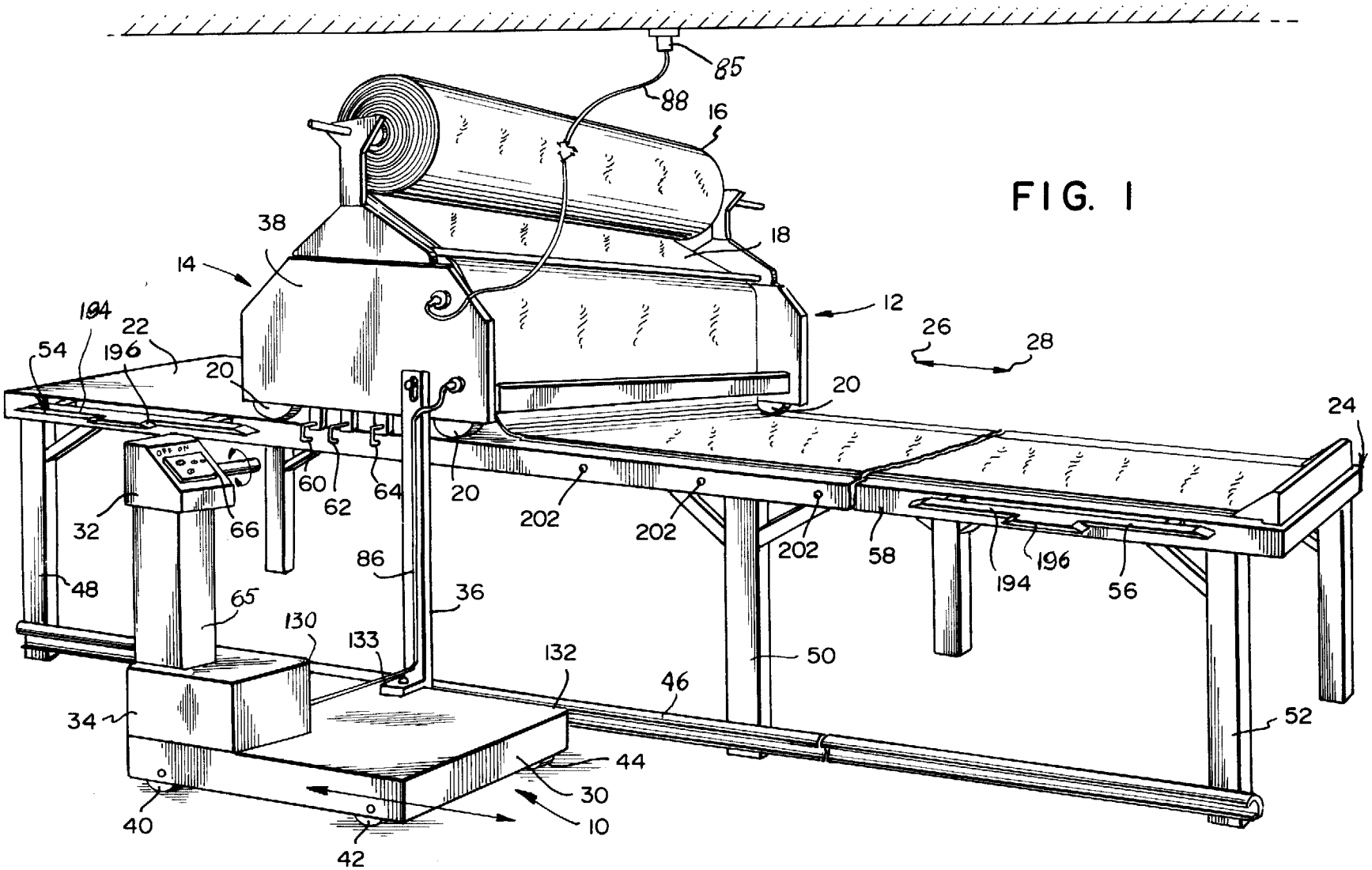
FIG. 1 is a perspective view of a drive platform made in accordance with the present invention and shown installed on a manually-operable fabric spreading machine.

With reference to the drawing there is shown in FIG. 1 a drive platform assembly 10, made in accordance with the present invention, with the drive platform 10 shown mounted on a manually operated fabric spreading machine 12.

The fabric spreading machine 12 is of a conventional nature and includes a carriage assembly 14 upon which is mounted a supply roll 16 of fabric 18. The carriage assembly 14 includes wheels or rollers 20 which enable the carriage assembly 14 to roll back and forth along the surface 22 of the cutting table 24 in the opposite directions shown by the arrows 26, 28, in order to deposit fabric 18 from the supply roll 16 onto the cutting table 24. This type of manual fabric spreading machine is conventionally operated by physically pushing the carriage assembly 14 along the table in order to spread the fabric onto the surface 22 of cutting table 24.

The drive platform assembly 10, according to the present invention, includes a generally rectangular drive platform 30 upon which is mounted a operator's control station 32, a motor housing 34 and an upstanding drive bar 36. The drive bar 36 connects the drive platform 30 to the side plate 38 of the carriage assembly 14. As the drive platform 30 is driven in the forward and reverse directions shown by the arrows 26, 28 by a set of four drive wheels, three of which are shown in FIG. 1 and identified by the reference numerals 40, 42, 44, the carriage assembly 14 is pulled by the drive bar 36 and moves with the drive platform apparatus 10. The motion of the drive platform apparatus 10 is guided by a track 46, which is mounted on the legs 48, 50, 52 of the cutting table 24. The apparatus 10 also includes a pair of longitudinally spaced cam assemblies 54, 56, mounted at the edge 58 of the cutting table 24, which cam assemblies cooperate with limit switches 60, 62, 64, which are mounted on the side plate 38, of the spreading machine carriage assembly to slow down, stop and reverse the motion of the drive platform apparatus 10 at each end of the fabric spreading stroke.

The motor housing 34 is mounted on the top surface of drive platform 30 and supports an upright elongated hollow standard 65, at the top of which is mounted the control station 32 having a control panel 66 thereon.

Figure 3:
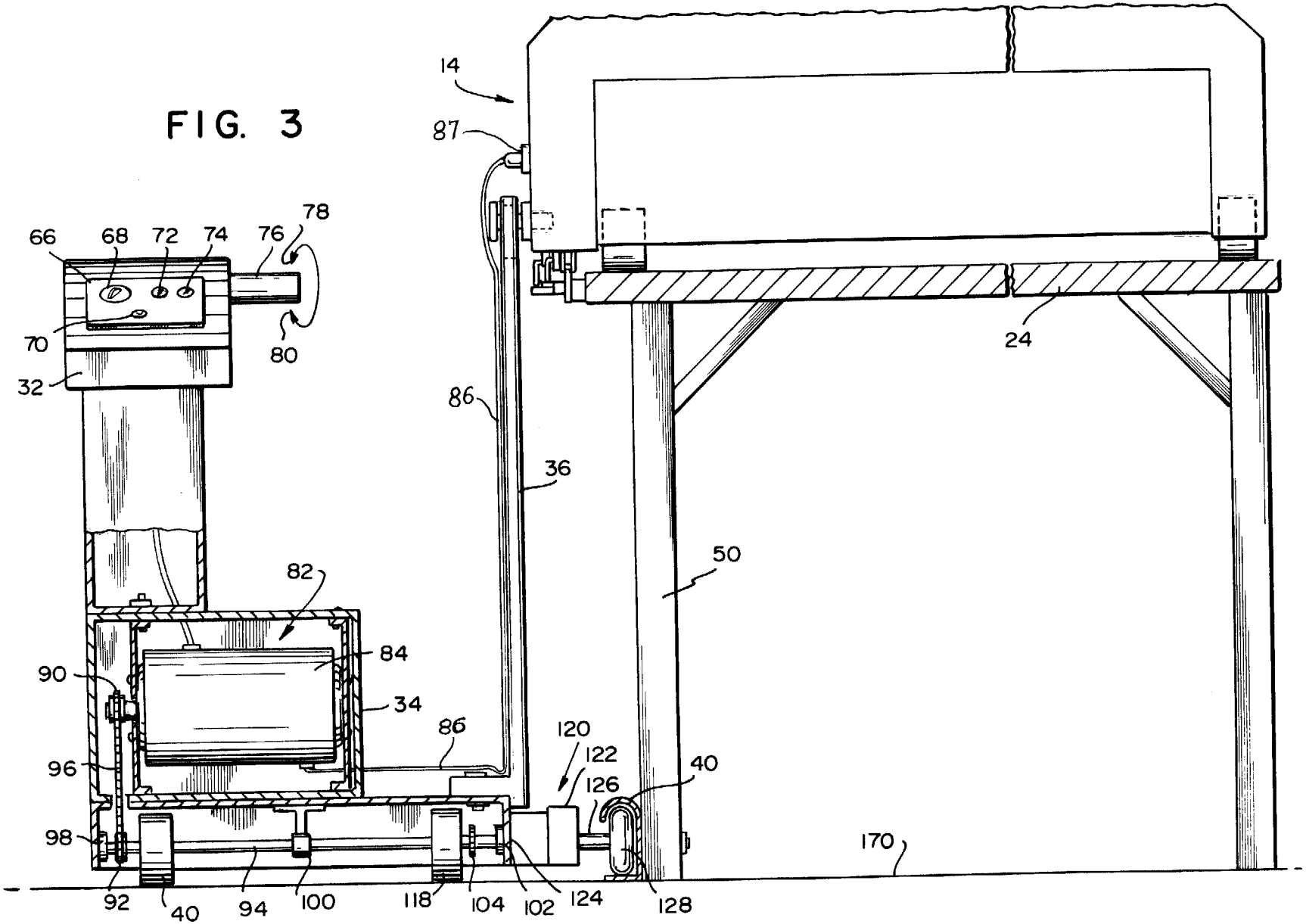
FIG. 3 is a view, partially in section, taken along the line 3—3 of FIG. 2.

As is best shown in FIG. 3, the panel 66 on the operator's control station 32 includes a power switch 68, a fuse holder 70 and a pair of indicator lights 72, 74. The indicator lights 72, 74 indicate the direction of motion, forward or reverse of the drive platform 30. The speed of the drive platform 30 may be controlled by rotation of a speed control bar 76 which projects from the operator's control station 32. The directions of rotation of the speed control bar are indicated by the arrows 78, 80.

Figure 2:
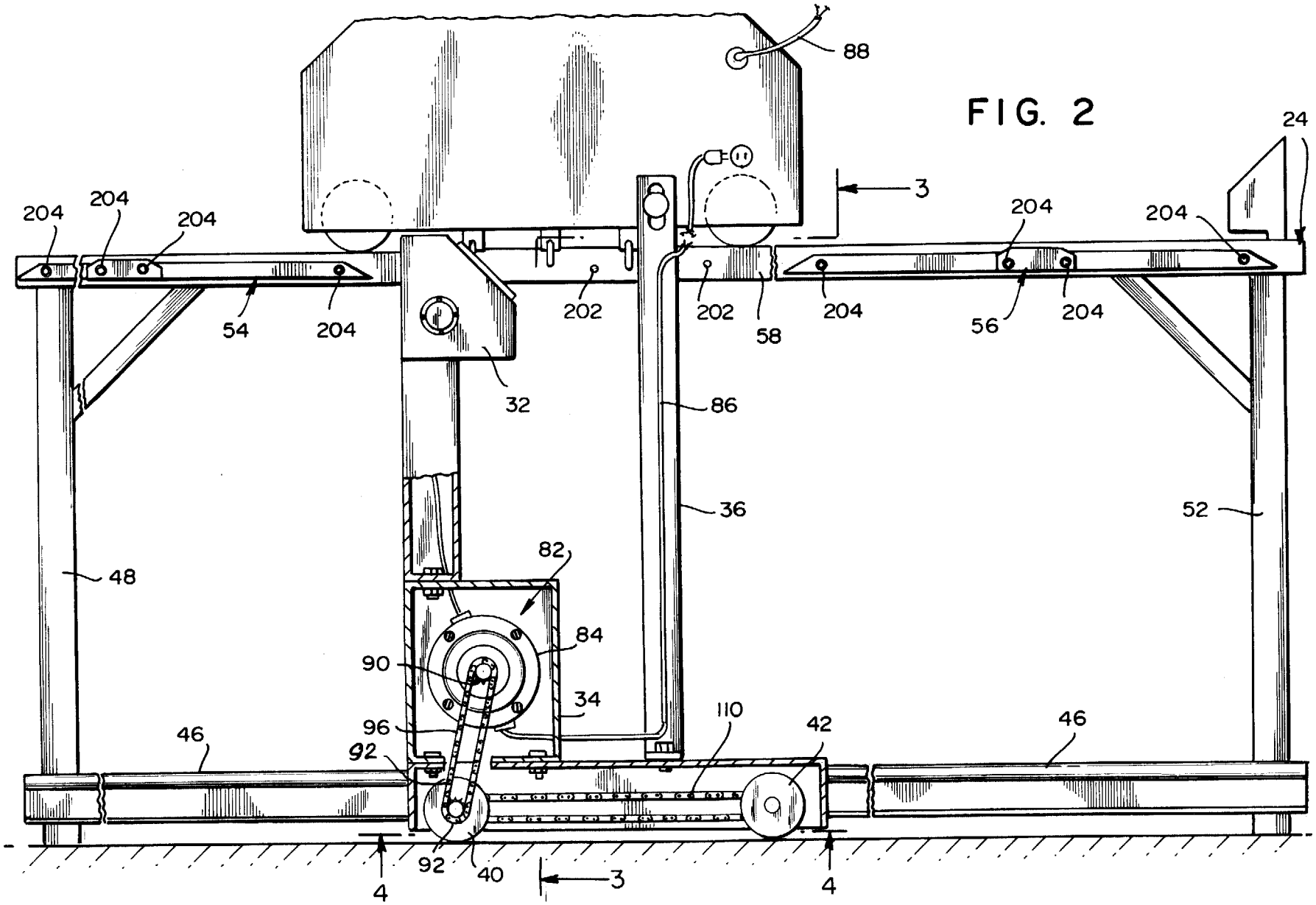
FIG. 2 is a side elevation view of the apparatus of FIG. 1 with portions shown broken away to reveal details of internal construction.
Figure 4:
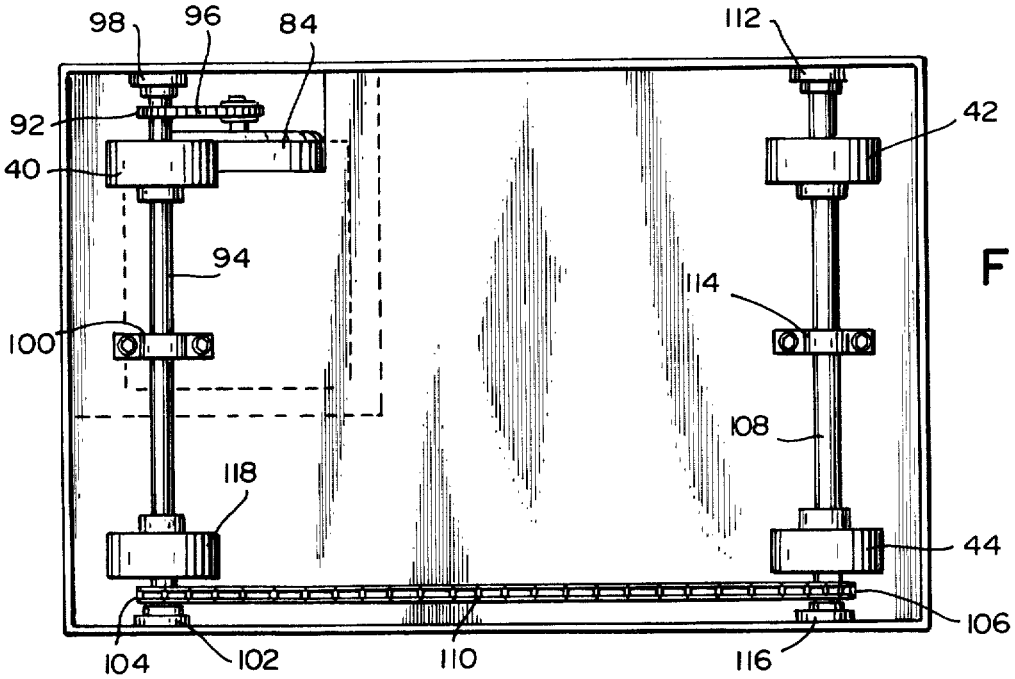
FIG. 4 is a view taken along the line 4—4 of FIG. 2.

The drive assembly 82 of the drive platform apparatus 10 is best shown in FIGS. 2, 3 and 4 and includes a drive motor 84 which is mounted in the motor housing 34 and is connected to a source of electric power via cables 86 and 88. Conventional manually operable spreading machines, such as the machine 12 shown in FIG. 1, are often provided with internal electrical circuitry for energizing fabric edge alignment apparatus, fabric cutting devices and other components. This internal circuitry is connected by the cable 88 to a power source socket 85 located in the ceiling of the cutting room above the cutting table 24. The spreading machine 12 has another socket 87 mounted on the side plate 38 and connected to the internal circuitry of the machine. The cable 86 connects the platform drive motor 84 to this socket 87 for energization of said drive motor. If the spreading machine does not include internal electrical circuitry or the socket 87, then the cable 86 would be connected directly to the power source ceiling socket 85.

As shown in FIGS. 2, 3 and 4, the output shaft of the drive motor 84 carries a drive sprocket 90 which is connected, via a drive chain 96, to a sprocket 92 which is mounted on an axle 94. Also keyed to the axle 94 is a drive sprocket 104 which is connected via a drive chain 110 to a sprocket 106, which is mounted on an axle 108. The axle 108 is journalled in bearings 112, 114, 116 which are connected to the drive platform 30. The drive chains 96, 110 enable the drive motor 84 to drive the four drive wheels 40, 42, 44, 118 which are mounted on the axles 94 and 108.

The drive motor 84 is a conventional electric motor and is preferably a reversible D.C. motor, although other types of electric motors may also be used.

Figure 5:
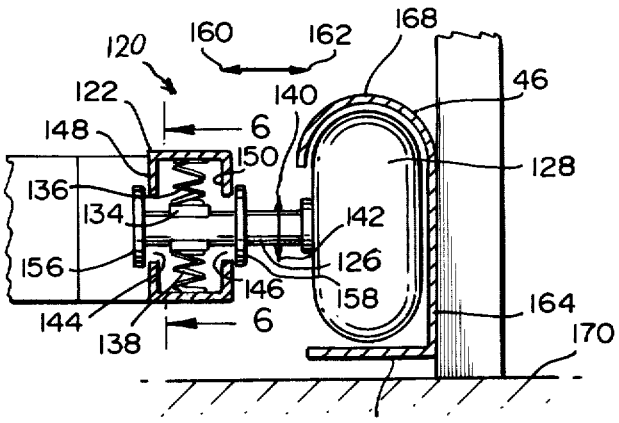
FIG. 5 is a fragmentary elevation view, partially in section, showing the guide wheel and track assembly of the apparatus of FIG. 1.
Figure 6:
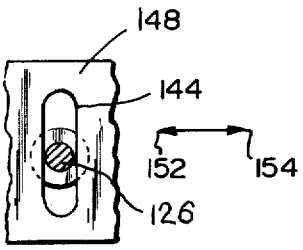
FIG. 6 is a fragmentary sectional view taken along the line 6—6 of FIG. 5.
Figure 8:
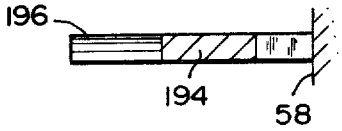
FIG. 8 is a sectional view taken along the line 8—8 of FIG. 7.

The drive platform apparatus 10, according to the present invention, includes a pair of identical guide wheel assemblies 120 mounted in spaced relationship on the inner side of platform 30 and cooperating with the track 46 to guide the motion of the drive platform apparatus. The details of construction of the guide wheel assembly 120 are best shown in FIGS. 3, 5 and 6 wherein it will be seen that each assembly 120 includes a housing 122 which is mounted on the side 124 of the platform 30, an axle 126, and a guide wheel 128. One guide wheel assembly 120 is located proximate the location indicated by the reference numeral 130 in FIG. 1. The other guide wheel assembly 120, is located proximate the location indicated by the reference numeral 132. The two guide wheel assemblies are identical and therefore the second guide wheel assembly need not be further described.

As is best shown in FIG. 5, the axle 126 is journalled in a bearing 134 which is mounted on springs 136 and 138. The springs 136, 138 permit motion of the axle 126 relative to the housing 122 in the vertical direction as indicated by the arrows 140, 142. The axle 126 passes through vertically elongated slots 144, 146 which are formed in the walls 148, 150 of the housing 122. One of the slots 144 is shown, drawn in an enlarged scale, in FIG. 6. The slots 144, 146 permit the axle 126 to move relative to the housing along the vertical directions indicated by the arrows 140, 142 and prevent motion of the axle 126 relative to the housing 122 in the horizontal direction, indicated by the arrows 152, 154.

The axle 126 includes collars 156, 158, which are positioned proximate to the walls 148, 150 of the housing 122 and restrain longitudinal motion of the axle in the directions indicated by the arrows 160, 162 in FIG. 5.

As is best shown in FIG. 5, the track 40 comprises a vertical wall portion 164, a horizontal bottom portion 166, and a curved top portion 168. The wall portion 166 is attached to the legs 48, 50, 52 of the cutting table 24 as has been previously described. The curvature of the top portion 168 of the track 46 generally matches the curvature of the guide wheel 128. The top portion 168 of the track 46 extends over the guide wheel 128 and prevents motion of the guide wheel 128 in the vertical direction, shown by the arrow 140, and also in the horizontal direction, shown by the arrow 160. The wall portion 164 of the track 46 prevents motion of the guide wheel 128 in the direction shown by the arrow 162 and the bottom portion 166 prevents motion in the direction shown by the arrow 142. During operation of the apparatus 10, the drive wheels 40, 42, 44, 118 roll on the floor 170, as shown in FIG. 3, and the springs 136, 138 accommodate unevenness of the floor while enabling the guide wheels to be retained and guided by the track 46.

Figure 5A:
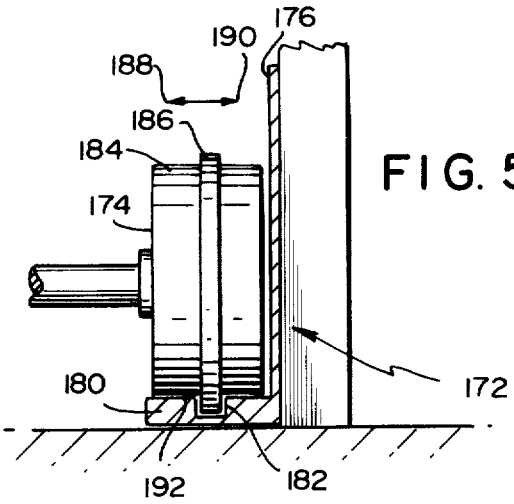
FIG. 5A is a fragmentary elevation view showing an alternative form of the guide wheel and track assembly of FIG. 5.

In an alternative embodiment of the guide wheel assembly 172 which is shown in FIG. 5A, the guide wheel 128 and track 46 of FIG. 5 are replaced by an alternative guide wheel 174 and an alternative track 176. The track 176 has a vertical wall portion 178 which is attached to the legs 48,50,52 of the cutting table 24, as has been previously described, and a horizontal portion 180 which includes a groove 182. The guide wheel 174 is generally cylindrical in shape, having a generally flat tread portion 184, and a central projecting rim 186 which projects into the groove 182. The engagement of the rim 186 with the groove 182 restrains motion of the guide wheel 174 in the horizontal directions shown by the arrows 188, 190. The tread 182 rolls along the top surface 192 of the horizontal portion of the track 180 thereby guiding the drive platform.

Figure 7:
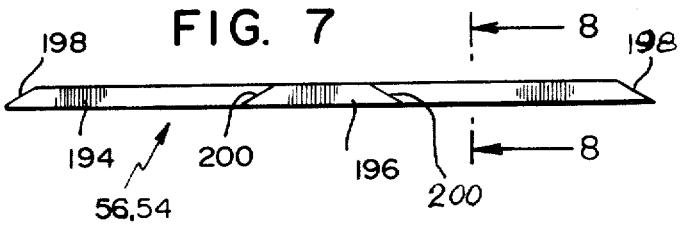
FIG. 7 is a side elevation view of the cam assembly of the apparatus of FIG. 1 with the cam assembly shown removed from the fabric spreading machine.

The cam assemblies 54, 56 each include a slowdown cam 194 which is mounted on the edge 58 of the cutting table 24 and a stop/reverse cam 196 which is mounted on the slowdown cam. The cam 194 is formed with inclined portions or ramps 198 at each end as shown in FIG. 7, and the cam 196 similarly has inclined portions or ramps 200 at each end. These ramps 198, 200 facilitate engagement with the limit switches 60, 62, 64 which are mounted on the side plate 38 of the carriage assembly 14. When the drive platform 30 has pulled the carriage assembly 14 in the right-hand direction shown by the arrows 28 in FIG. 1 up to a point close to the desired end of the spreading stroke, the limit switch 64 engages the slowdown cam 194 and an electrical signal causes the drive motor 84 to reduce speed. Further motion of the carriage assembly 14 in the same direction causes the limit switch 62 to engage the stop/reverse cam 196 thereby stopping and then reversing the direction of motion of the drive platform 30. In a similar manner, when the carriage assembly 14 has been pulled to the end of the desired stroke in the left-hand direction shown by the arrow 26, the limit switch 60 engages the slowdown cam 194 of the cam assembly 54, thereby slowing the speed of the drive platform 30, and further motion in the same direction causes the limit switch to engage the stop/reverse cam 196 thereby stopping and then reversing the direction of motion of the drive platform 30. During operation, an operator, standing on the drive platform 30, can easily inspect the fabric 18 as it is being deposited by the carriage assembly 14. The operator can also adjust speed of travel of the drive platform 30, thereby controlling the speed of the carriage assembly using the speed control bar 76.

The edge 58 of the cutting table 24 includes a plurality of tapped holes 202, which are shown in FIG. 1. The cam assemblies 54, 56 are mounted on the cutting table by means of bolts 204 shown in FIG. 2 which enter selected tapped holes. The position of the cam assemblies 54, 56 along the edge 58 of the cutting table 24 can be easily adjusted by unscrewing the bolts 204 and selecting alternative tapped holes 202. This adjustment of the cam assemblies 54, 56 permits easy adjustment of the length of the fabric spreading stroke of the apparatus 10.

While preferred embodiments of the invention have been shown and described herein, it is obvious that numerous additions, changes and omissions may be made in such embodiments without departing from the spirit and scope of the invention.

What is claimed is:

1. A drive platform assembly for a fabric spreading machine having a fabric spreading carriage mounted on a cutting table, said drive platform assembly comprising platform means disposed adjacent said fabric spreading machine, drive wheels mounted on said platform means, electrical drive motor means mounted on said platform means, driving connection means connecting said drive motor means and said drive wheels, electrical connection means for connection of said drive motor means to a source of electric power, control means for controlling starting, stopping and reversing motion of said platform means, and connecting link means connecting said platform means and said fabric spreading carriage thereby enabling said platform to drive said fabric spreading carriage.

2. A drive platform assembly according to claim 1 further comprising guide means for guiding the motion of said platform means.

3. A drive platform assembly according to claim 2 in which said guide means comprises a guide wheel assembly mounted on said platform means and a guide track mounted on said fabric spreading machine and cooperating with said guide wheel assembly to guide the motion of said platform means.

4. A drive platform assembly according to claim 3 in which said guide means comprises a pair of guide wheel assemblies mounted on said platform means and each cooperating with said guide track to guide the motion of said platform means.

5. A drive platform assembly according to claim 4 in which said guide wheel assemblies each comprises an axle mounted on said platform means and a guide wheel mounted on said axle.

6. A drive platform assembly according to claim 5 in which said platform means is disposed on a horizontal plane and further in which each of said guide wheel assemblies includes resilient mounting means supporting the respective axle and permitting relative motion between said axle and said platform means in a vertical direction substantially perpendicular to the plane of said platform means.

7. A drive platform assembly according to claim 6 in which said resilient mounting means includes restraint means capable of preventing relative motion between said axle and said platform means in a horizontal plane.

8. A drive platform assembly according to claim 1 in which said drive motor means comprises a reversible D.C. motor.

9. A drive platform assembly according to claim 1 in which said control means comprises a pair of cam means mounted, one each, proximate to ends of said cutting table, and switch means mounted on said fabric spreading carriage and cooperating with said cam means to slow, stop and reverse the motion of said platform means when said switch means come into contact with said cam means.

10. A drive platform assembly according to claim 9 in which said cam means are adjustably mounted on said cutting table.

11. A drive platform assembly according to claim 9 in which said control means further comprises speed control means for adjustment of the speed of travel of said platform means.

12. A drive platform assembly according to claim 1 further comprising a control panel having indicator means for indicating the direction of motion of said platform means.

* * * * *